US006873300B2

(12) United States Patent
Mendenhall

(10) Patent No.: US 6,873,300 B2
(45) Date of Patent: Mar. 29, 2005

(54) ANTENNA SYSTEM UTILIZING ELEVATED, RESONANT, RADIAL WIRES

(75) Inventor: Geoffrey Norman Mendenhall, Cincinnati, OH (US)

(73) Assignee: Harris Corporation, Melbourne, FL (US)

( * ) Notice: Subject to any disclaimer, the term of this patent is extended or adjusted under 35 U.S.C. 154(b) by 76 days.

(21) Appl. No.: 10/407,709

(22) Filed: Apr. 4, 2003

(65) Prior Publication Data

US 2004/0196206 A1 Oct. 7, 2004

(51) Int. Cl.[7] ..... H01Q 9/00
(52) U.S. Cl. ..... 343/750; 343/847; 343/874
(58) Field of Search ..... 343/749, 750, 343/751, 752, 846, 847, 874

(56) References Cited

U.S. PATENT DOCUMENTS

| | | | | |
|---|---|---|---|---|
| 2,998,604 A | * | 8/1961 | Seeley | 343/846 |
| 3,386,098 A | * | 5/1968 | Mullaney | 343/752 |
| 3,419,873 A | * | 12/1968 | Harris et al. | 343/847 |
| 3,482,249 A | * | 12/1969 | Mullaney | 343/750 |
| 3,742,511 A | * | 6/1973 | Smith et al. | 343/750 |

OTHER PUBLICATIONS

Ground Systems as a Factor in Antenna Efficiency, by G. H. Brown, R. F. Lewis and J. Epstein in the Proceedings of the Institute of Radio Engineers, vol. 25, No. 6, Jun. 1937.

"AM Broadcast Antennas with Elevated Radial Ground Systems", by A. Christman and R. Radcliff at 0018–9316/88/0300–0075$01.00, Copyright, 1988 IEEE, pp. 75–77.

* cited by examiner

*Primary Examiner*—Hoang V. Nguyen
(74) *Attorney, Agent, or Firm*—Tarolli, Sundheim, Covell & Tummino L.L.P.

(57) ABSTRACT

An antenna system is presented including an electrically conductive radiating mast that extends generally vertical relative to earth ground. The mast has a lower end for receiving RF energy for radiation thereby at an operating RF frequency and an upper end. A plurality of N radial, electrically conductive, wires are provided with each having an inner end and an outer end. The inner ends of the radial wires are electrically connected together and located proximate to the vertical mast. The radial wires are elevated throughout their lengths above the level of earth ground and extend radially outward from the vertical mast. A tuning device, such as an adjustable inductor, is connected to the radial wires for adjusting the impedance thereof such that the radial wires resonate at the operating frequency.

16 Claims, 2 Drawing Sheets

ANTENNA SYSTEM UTILIZING ELEVATED, RESONANT, RADIAL WIRES

BACKGROUND OF THE INVENTION

1. Technical Field

The present invention relates to the art of RF broadcasting antenna systems and, more particularly, to such a system intended for medium wave broadcasting employing a vertically oriented radiator in the form of a mast, together with a plurality of elevated resonant radial wires.

2. Description of the Prior Art

Antenna systems employing a vertical radiator together with radial wires are known in the art. This, for example, includes an article entitled "Ground Systems As A Factor In Antenna Efficiency" by G. H. Brown, R. F. Lewis and J. Epstein in the Proceedings of the Institute of Radio Engineers, Volume 25, No. 6, June 1937. Such a system with elevated radial wires is described in an article entitled "AM Broadcast Antennas With Elevated Radial Ground Systems" by A. Christman and R. Radcliff at 0018-9316/88/0300-0075$01.00, Copyright 1988 IEEE, note pages 75–77.

It is to be noted that the above publications do not describe that the radial wires are tuned so as to resonate at the operating frequency of the vertical radiator. Moreover, it is to be noted that the vertical radiators in these publications are not provided with top loading antenna wires. Also, they do not disclose that such top loading wires be provided in combination directly above the elevated resonant radial wires.

SUMMARY OF THE INVENTION

The present invention contemplates the provision of an medium wave antenna system constructed so as to be smaller and lighter than a full size, quarter wavelength antenna and, as such, may be transportable. The system has the capability of generating far field intensities on the order of 70% of a full size antenna over normal soil conductivity of 4–8 milliohms per meter in the operating frequency range of 1200 to 1700 kilohertz. This is obtained by constructing an antenna in accordance with the present invention wherein the radiation efficiency is maximized by dramatically reducing ground resistance losses compared to conventional antenna designs. For example, in one version, top loaded wires are located directly above resonant radial wires so that substantially all of the electric field lines are efficiently captured.

Moreover, the present invention contemplates a compact antenna system having a lower radiation resistance than a full size one quarter wavelength antenna system which makes reduction of ground loss resistance more important than with a full size antenna. Ground losses are reduced and high efficiency is achieved by elevating the radial wires above the ground surface directly below the top loading wires and electrically resonating the radial wires with a series inductor. It has been found in practicing this invention that up to 95% of the RF current flowing in the vertical radiator may be captured by the resonant radial system instead of being dissipated in the ground resistance.

In accordance with one aspect of the present invention, there is provided an electrically conductive radiating mast that extends generally vertical relative to earth ground and wherein the vertical mast has a lower end for receiving RF energy for radiation thereby at an operating RF frequency and an upper end. A plurality of N radial electrically conductive wires are provided with each having an inner end and an outer end. The inner ends of the radial wires are electrically connected together and located proximate to the vertical mast. A tuning device, such as an adjustable inductor, tunes the radial wires to resonate at the operating frequency.

In accordance with another aspect of the present invention, an antenna system is provided including an electrically conductive radiating mast that extends generally in a vertical direction relative to earth ground and has a lower end for receiving RF energy for radiation thereby and an upper end. A plurality of N radially extending top loading electrically conductive wires have their inner ends connected to the inner ends of the other loading elements and to the mast. The top loading elements each have a distant end that is electrically insulated from but mechanically connected to one end of a guide line that extends therefrom and is anchored to earth ground.

BRIEF DESCRIPTION OF THE DRAWINGS

The foregoing and other objects and advantages of the invention will become more readily apparent from the following description as taken in conjunction with the accompanying drawings, wherein.

DESCRIPTION OF THE PREFERRED EMBODIMENT

Figure 1:
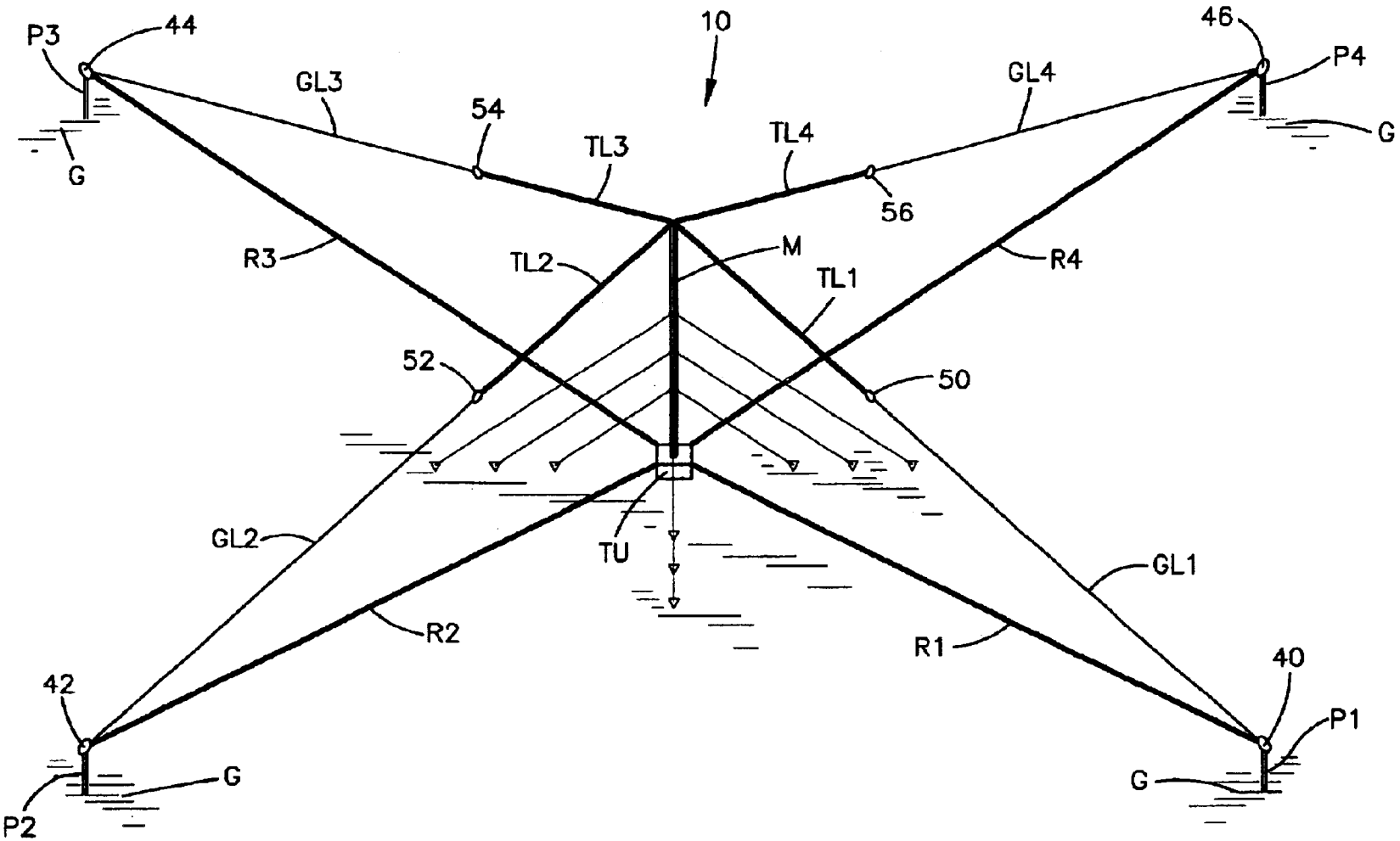
FIG. 1 is an isometric view of an antenna system incorporating the present invention.

Reference is now made to FIG. 1 which illustrates the antenna system 10 constructed in accordance with the present invention. The following is a brief overall description of the antenna as shown in FIG. 1. This description will be followed by a description of the theory involved in the operation of the antenna and this, in turn, will be followed by a detailed description of the structural and electrical features of the antenna.

As shown in FIG. 1, the antenna system 10 includes a vertically extending, electrically conductive mast M which extends upwardly from a tuning unit TU (to be described in greater detail hereinafter). The mast terminates in an upper end from which extends four radially extending top loading wires TL1, TL2, TL3 and TL4. Four radial wires R1, R2, R3 and R4 extend radially outward from the mast and protrude from the tuning unit TU. These radial wires are elevated above the level of the earth ground G.

Having briefly described the system, attention is now directed to the operational features.

The top loading wires, which are made of electrically conductive materials such as copper or the like, are placed directly above the radial wires. The radial wires are tuned by circuitry within the tuning unit TU so that they resonate at a frequency corresponding to the operating frequency of the vertical radiator or mast M. This captures as much of the field as possible to minimize the portion of the electric field returned through the higher resistance (soil) ground G. A full sized broadcast antenna of this nature such as that described in the G. H. Brown et al. article noted above, utilizes 120 radial wires buried just below the ground surface to obtain low ground resistance losses. The use of elevated resonant radial wires as shown in FIG. 1 herein, is intended to reduce the ground resistance losses with many fewer and shorter radial wires than those employed in a full-size medium wave antenna such as that described in the aforesaid article.

This antenna has an operating frequency in the range from approximately 1197 KHz to approximately 1,710 KHz with the performance maximized at the upper end of this frequency range.

The radiation resistance of this antenna is about ⅓ that of a ¼ wavelength radiator so that minimizing ground resistance is important and this is achieved with the structure as described herein.

The mast M is preferably a telescoping mast so that it may be extended to a height on the order of 50 feet above ground level G.

The mast M is top loaded with the radially extending top loading wires TL1–TL4, which are each about 50 feet long and are constructed of electrically conductive material. The top loading wires are located directly over the radial wires. For example, the top loading wire TL1 is in registry with and directly over radial wire R1 so that they define a common vertical plane with the mast M. As viewed from above, the top loading wires are spaced from each other by about 90°. This top loading represents a capacitance to the radial wires which lowers the self-resonant frequency of the vertical radiator. As will be discussed hereinafter, the tuning unit TU includes means for providing additional tuning and impedance matching.

The radial wires R1, R2, R3 and R4 may each be of a length on the order of three times the height of mast M. Thus, the radial wires may extend for a distance on the order of 145 to 150 feet, for example. This makes the radial wires self resonant just above the highest operating frequency of the antenna.

The radial wires R1–R4 are tuned so as to resonate at approximately the operating frequency of the mast M. The far ends of the radial wires are each connected to an insulator. The radial wires are elevated to approximately 10 feet of the level of earth ground G at their distant ends. The near ends are insulated from ground and extend into the tuning unit TU and, as will be described in greater detail hereinafter, are connected together in common and thence to an adjustable tuning inductor which is connected in series with an RF current sampling transformer to circuit ground. The variable inductor allows the radial wires to be "gang tuned" to resonate at a frequency corresponding with the operating frequency of the mast M. In addition, an identical current sampling transformer is inserted in series with the vertical radiator mast, so that the ratio of the current in the vertical radiator can be directly compared with the current returned by the radial wires. It is believed that greater than 80% of the vertical radiator current will be captured and returned with low loss by the resonant elevated radial wires.

The low radiation resistance of the vertical radiator mast M is transformed up to approximately 50 ohms to match the 50 ohms coaxial transmission line that extends (FIG. 2) from the antenna system into a transmitter. This matching is achieved by an adjustable inductor in series with the vertical radiator mast to bring the antenna resonant frequency just above the operating frequency so that the remaining series capacitive reactance is equal to the value required to transform the radiation resistance up to 50 ohms across the proper shunt inductive reactance required to cancel the capacitive reactance and complete the impedance transformation.

Figure 2:
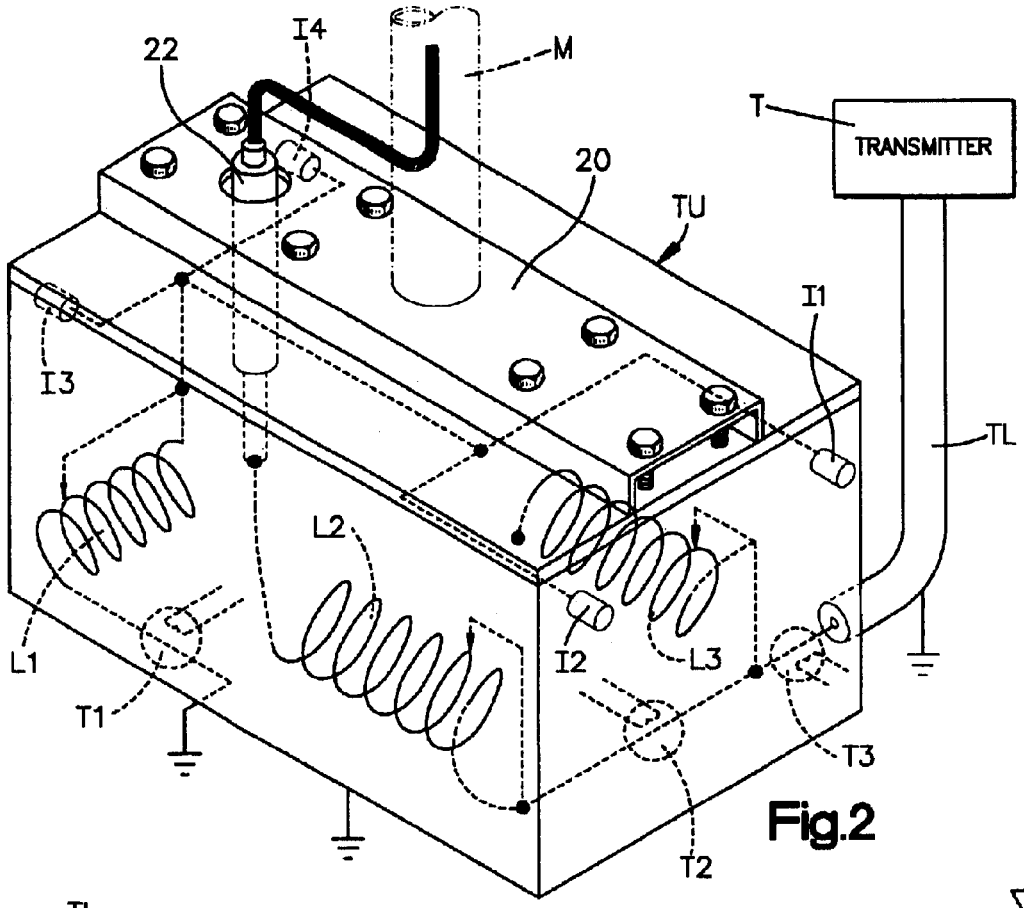
FIG. 2 is a perspective view of an antenna tuning unit that supports the antenna mast and contains various tuning elements.
Figure 3:
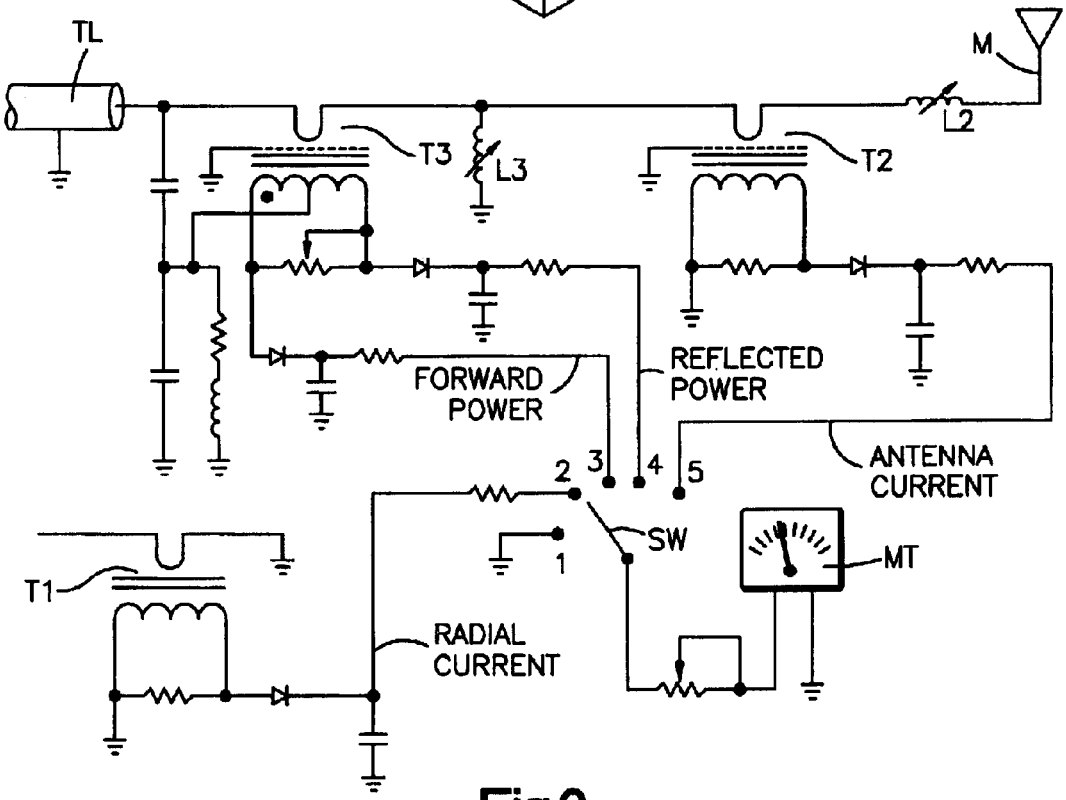
FIG. 3 is an electrical schematic circuit diagram of the circuitry employed in the antenna tuning unit.

Reference is now made to FIG. 1 in conjunction with FIGS. 2 and 3 with a more specific description of the structural aspects of the illustrated embodiment.

The radial wires R1–R4 extend from the tuning unit TU to suitable insulators 40, 42, 44 and 46 and thence to respective mounting poles P1, P2, P3 and P4. These poles may be constructed of suitable electrical insulating material. These poles extend from the level of ground G upward to an extent of approximately 10 feet and are suitably secured to the ground to provide support. The inner ends of the radial wires extend through insulators I1, I2, I3 and I4 located in the respective side walls of the tuning unit TU. These wires extend inwardly and are connected together in common and thence through an adjustable series inductor L1 to ground. The inductor L1 is employed for adjusting the radial wires to resonate at a frequency corresponding to the operating frequency of the vertical radiator mast M. The inductor L1 is adjusted by a suitable adjustment arm, conventional in the art. The conductor then extends through a radial current sampling transformer T1 to circuit ground.

The lower end of the vertical mast is supported by an electrically insulating inverted U-shaped bracket 20 that is suitably secured to the roof of the tuning unit TU. The tuning unit includes a metal box having sidewalls, a floor and a roof. The mast M may be secured to the insulator bracket 20 as with a suitable mechanical connection (not shown). The mast is electrically connected to a conductor that extends through an insulator 22 that extends through bracket 20 and the roof of the tuning unit TU. The conductor extends to one end of an adjustable inductor L2 that serves to adjust the current flowing therethrough and to assist in providing impedance matching with the 50 ohm coaxial transmission line TL. This inductor may be adjusted to bring the antenna frequency to a point just above the operating frequency so that the remaining series capacitive reactance is equal to the value required to transform the radiation resistance up to 50 ohms across the proper shunt inductive reactance required to cancel the capacitive reactance and complete the impedance transformation. A series current sample indicative of the magnitude of the current flowing in this series circuit may be obtained from a current transformer T2 connected in series with the inductor L2. An adjustable shunt inductor L3 has one end thereof connected to the junction of inductor L2 and the coax cable TL and the other end connected to circuit ground (by connection, for example, to the floor of the tuning unit housing). A series current sample useful for determining reflected power is obtained from a current transformer T3.

The top loading wires TL1–TL4 may each be of a length on the order of 45–50 feet with the far ends of each wire terminating in a connection to an insulator and then extending with a non-conductive guy line, such as a nylon rope, to one of the posts P1–P4. Thus, the top loading wire TL-1 is connected at its far end to a suitable insulator 50 which is, in turn, connected to a guy line GL1. Similarly, the top loading wire TL2 terminates in an insulator 52 which is connected to the upper end of post P2 by way of a guy line GL2, identical to that of guy line G1. Also, the top loading wire TL3 terminates at its far end to an insulator 54 and, thence, to the post P3 by way of a guy line GL3, identical to guy lines GL1 and GL2. Also, the top loading wire TL4, has its far end terminating with an insulator 56 which is connected to the upper end of a post P4 by way of a guy line GL4 and which is identical to guy lines GL1–GL3. These guy lines GL1 to GL4 are each on the order of 100 feet in length.

The circuitry employed within the tuning unit TU is illustrated in FIG. 2 and in the schematic circuitry of FIG. 3. The circuitry includes a multimeter MT, together with a three position switch SW having positions 1, 2, 3, 4 and 5.

When the switch is in position 3, the meter MT will indicate relative forward power delivered by the transmitter into the antenna. When the switch is in position 4, the meter MT will provide an indication of relative power reflected back from the antenna into the transmitter. The reflected power should always be minimized. When the switch is in position 2, the meter MT indicates the relative current being collected by the radial wires from the vertical radiator and returned to the matching network. The radial current is normally 85–95% of the vertical radiator antenna current. In position 5, the meter indicates antenna current.

From the above description of the invention, those skilled in the art will perceive improvements, changes and modifications in the invention. Such improvements, changes and modifications within the skill of the art are intended to be covered by the appended claims.

Having described the invention, I claim the following:

1. An antenna system comprising:

an electrically conductive radiating mast that extends generally vertical relative to earth ground, said mast having a lower end for receiving RF energy for radiation thereby at an operating RF frequency and an upper end;

a plurality of N radial, electrically conductive, wires each having an inner end and an outer end, the inner ends of said radial wires being electrically connected together and located proximate to said vertical mast, said radial wires being elevated throughout their lengths above the level of earth ground and extending radially outward from said vertical mast;

a tuning device that tunes said radial wires to resonate at the operating frequency;

a plurality of top loading wires extending radially outward from the upper end of said antenna mast; and wherein there are N said loading wires.

2. An antenna system as set forth in claim 1 wherein said tuning device includes an adjustable inductor.

3. A tuning device as set forth in claim 1 wherein said inductor is connected in series circuit with said radial wires.

4. An antenna system as set forth in claim 1 wherein each said loading wire is directly over and is in registry with one of said radial wires.

5. An antenna system as set forth in claim 4 wherein said tuning device includes an adjustable inductor.

6. An antenna system as set forth in claim 1 wherein said inductor is in series circuit with said radial wires.

7. An antenna system as set forth in claim 6 wherein each said loading wire is directly over and is located in the same plane as one of said radial wires.

8. An antenna system as set forth in claim 7 wherein said tuning device includes an adjustable inductor.

9. An antenna system as set forth in claim 8 wherein said inductor is in series circuit with said radial wires.

10. An antenna system as set forth in claim 1 wherein each said loading wire is connected to one end of a guy line, of insulating material, having another end secured to a means for securing same to earth ground.

11. An antenna system as set forth in claim 10 wherein said tuning device includes an adjustable inductor.

12. An antenna system as set forth in claim 11, wherein said inductor is in series circuit with said radial wires.

13. An antenna system comprising:

a vertical radiator mast of electrically conductive material that extends generally in a vertical direction relative to earth ground, said mast having a lower end for receiving RF energy for radiation thereby at an operating RF frequency and having an upper end;

a plurality of N radially extending top loading electrically conductive wires each having an inner end and an outer end with said inner ends being electrically connected together and located proximate to said mast and extending radially outward therefrom, the outer end of each said top loading wire being connected to one end of a guy line by way of an electrical insulator with said guy line extending to a distant end which is anchored to earth ground; and a plurality of N radial, electrically conductive wires each having an inner end and an outer end, the inner ends of said radial wires being electrically connected together and located proximate to said vertical mast, said radial wires being elevated throughout their lengths above the level of earth ground and extending radially outward from said vertical mast; and a tuning device that tunes said radial wires to resonate at the operating frequency.

14. An antenna system as in claim 13, wherein each said loading wire is directly over and is located in the same plane, as one of said radial wires.

15. An antenna system as set forth in claim 14, wherein said tuning device includes an adjustable inductor.

16. An antenna device as set forth in claim 15, wherein said inductor is in series circuit with said radial wires.

* * * * *

UNITED STATES PATENT AND TRADEMARK OFFICE

CERTIFICATE OF CORRECTION

PATENT NO. : 6,873,300 B2
DATED : March 29, 2005
INVENTOR(S) : Geoffrey Norman Mendenhall It is certified that error appears in the above-identified patent and that said Letters Patent is hereby corrected as shown below:

Column 5,
Line 46, after "claim" change "1" to -- 5 --.

Signed and Sealed this

Sixteenth Day of August, 2005

JON W. DUDAS
*Director of the United States Patent and Trademark Office*